US006574814B2

(12) United States Patent
Collard et al.

(10) Patent No.: US 6,574,814 B2
(45) Date of Patent: Jun. 10, 2003

(54) BEDDING OR SEATING PRODUCT HAVING FILLED TUBE TOPPER

(75) Inventors: John Leslie Collard, Ennis, TX (US); Sidney A. Hiatt, Carthage, MO (US); Eddie L. Parvin, Corinth, MS (US)

(73) Assignee: L&P Property Management Company, South Gate, CA (US)

( * ) Notice: Subject to any disclaimer, the term of this patent is extended or adjusted under 35 U.S.C. 154(b) by 75 days.

(21) Appl. No.: 09/804,208

(22) Filed: Mar. 12, 2001

(65) Prior Publication Data

US 2001/0047551 A1 Dec. 6, 2001

Related U.S. Application Data

(60) Provisional application No. 60/252,287, filed on Nov. 21, 2000, and provisional application No. 60/189,169, filed on Mar. 14, 2000.

(51) Int. Cl.[7] ..... A47C 27/10

(52) U.S. Cl. ..... 5/716; 5/718; 5/655.9

(58) Field of Search ..... 5/716, 718, 720, 5/721, 740, 655.9, 691

(56) References Cited

U.S. PATENT DOCUMENTS

| | | | | | |
|---|---|---|---|---|---|
| 3,900,648 | A | * | 8/1975 | Smith | 428/317.9 |
| 4,221,013 | A | | 9/1980 | Echevarria | |
| 4,449,261 | A | * | 5/1984 | Magnusson | 5/630 |
| 4,843,666 | A | * | 7/1989 | Elesh et al. | 5/723 |
| 4,879,776 | A | | 11/1989 | Farley | |
| 4,924,541 | A | * | 5/1990 | Inagaki | 297/DIG. 3 |
| D311,108 | S | | 10/1990 | Farley | |
| D316,202 | S | | 4/1991 | Farley | |
| 5,010,609 | A | | 4/1991 | Farley | |
| 5,172,439 | A | | 12/1992 | Farley | |
| 5,178,811 | A | | 1/1993 | Farley | |
| 5,259,079 | A | | 11/1993 | Visser et al. | |
| D352,858 | S | | 11/1994 | Farley | |
| 5,430,901 | A | | 7/1995 | Farley | |
| 5,533,218 | A | | 7/1996 | Fahy | |
| 5,655,241 | A | * | 8/1997 | Higgins et al. | 5/499 |
| 5,704,085 | A | * | 1/1998 | Sabalaskey | 5/717 |
| 5,745,940 | A | | 5/1998 | Roberts et al. | |
| 5,815,865 | A | | 10/1998 | Washburn et al. | |
| 5,974,609 | A | | 11/1999 | Nunez et al. | |
| 5,987,668 | A | | 11/1999 | Ackley | |
| 6,006,383 | A | | 12/1999 | Pile et al. | |
| 6,061,856 | A | | 5/2000 | Hoffmann | |
| 6,145,143 | A | | 11/2000 | Hicks et al. | |

FOREIGN PATENT DOCUMENTS

| | | |
|---|---|---|
| DE | 39 37 214 | 5/1991 |

* cited by examiner

*Primary Examiner*—Teri Pham Luu
*Assistant Examiner*—Fredrick Conley
(74) *Attorney, Agent, or Firm*—Wood, Herron & Evans, L.L.P.

(57) ABSTRACT

A mattress or bedding product is covered with a topper comprising individual tubes, each of which is filled with shredded foam/fiber material. In one embodiment, the topper has a foam layer having a number of arcuate-shaped cradles in which are placed the individual tubes. The shredded foam/fiber materials may be modified as required to provide different density and/or firmness characteristics to different portions of the product.

10 Claims, 5 Drawing Sheets

BEDDING OR SEATING PRODUCT HAVING FILLED TUBE TOPPER

CROSS REFERENCE TO RELATED APPLICATIONS

This application claims the benefit of U.S. Provisional Patent Application No. 60/252,287 filed Nov. 21, 2000 entitled "Tube Bed System." This application also claims the benefit of U.S. Provisional Patent No. 60/189,169 filed Mar. 14, 2000 entitled "Tube Bed System."

FIELD OF THE INVENTION

This invention relates to bedding or seating products in general and, more particularly, to a bedding or seating product having a topper incorporating tubes filled with filler material.

BACKGROUND OF THE INVENTION

Various types of bedding products have been developed from feather beds to the more modern coil spring mattress which provide a comfortable sleeping surface. Currently, popular coil spring mattresses consist of coil springs disposed between layers of padding and encased in a ticking or fabric covering. Various springs are used to create mattresses of different firmness characteristics. The firmness of a mattress is generally determined by the firmness of the coil springs in the spring unit or spring assembly. Additional comfort in a mattress may be provided by a "pillow top" or "quilt top". Such a mattress has a pillow or quilt material added to one or both of the faces of the mattress. The pillow top or quilt top may enclose foam cushions, batting or similar materials to provide an increased loft and comfortable feel to the mattress.

Known bedding products such as mattresses, including those having a pillow top or quilt top, are commonly sold as a manufactured unit having a uniform firmness throughout the mattress such that one zone or region of the mattress has the same firmness and performance characteristics as every other portion of the mattress.

However, it is commonly recognized in the bedding industry that certain regions of a mattress may require different performance or firmness characteristics to support various areas of the human body. For example, the region of the mattress which underlies the torso of a human being supports a substantial portion of the weight of that person; whereas the regions of the mattress which underlie the head and feet are required to support less of the weight of an individual. As such, it is desirable that a mattress or bedding product have multiple zones or regions of differing firmness. The different firmnesses of the zones or regions are commonly due to the characteristics of the springs within the different zones or regions. Constructing such a posturized mattress requires assembling springs having different characteristics such as different thickness, for example, into a spring assembly. This process is more complicated, time consuming and expensive than making a spring assembly of identical springs.

Therefore, it has been a primary objective of this invention to provide a bedding or seating product which offers the advantages of standard coil spring construction while providing multiple zones or regions of different firmness.

Another objective of the present invention has been to provide a topper having unique firmness characteristics which may be selected by a manufacturer and assembled into a bedding or seating product according to the manufacturer's preferences.

SUMMARY OF THE INVENTION

The present invention which accomplishes these objectives comprises a bedding or seating product having a conventional spring assembly covered by a topper. The topper may cover only one or multiple surfaces of the spring assembly. A product in which the topper covers only one surface of the spring assembly is commonly referred to as a one sided product. Similarly, a product in which toppers cover upper and lower surfaces of the spring assembly is commonly referred to as a two sided product. In either event, a fabric covering preferably encases both the spring assembly and the topper or toppers.

The topper of the present invention may assume numerous configurations in accordance with the present invention. However, each of the embodiments of the topper incorporates a plurality of individual tubes oriented in a parallel relationship. Each of the tubes is, at least partially filled with filler material.

One embodiment of the present invention incorporates a topper having first and second foam layers sandwiching a plurality of individual tubes, each at least partially filled with filler material. A first or lower foam layer is positioned atop the spring assembly and has a plurality of generally parallel and arcuate-shaped cradles formed in a top surface of the foam layer. A plurality of individual tubes, each of which is, at least partially filled with filler material, are each positioned in one of the cradles of the foam layer and secured thereto by adhesive or the like.

A second or upper foam layer is positioned atop the individual tubes. The second or upper foam layer has a lower surface in which a plurality of generally parallel and arcuate-shaped cradles are formed, the cradles being sized and adapted to receive the individual filled tubes. Additional foam layers may be placed over the topper if desired. If desired, the upper foam layer may be omitted, in which case the topper would comprise only the tubes and the lower foam layer.

The individual tubes are preferably filled with shredded foam and shredded fiber materials. However, they may be filled with solely shredded pieces of foam or solely with shredded fibers. Other materials such as down feathers or wool may be used to fill the individual tubes to the desired firmness.

The filler materials in some of the tubes may have a different density and/or firmness than the filler materials in other tubes to thereby customize the mattress with different firmness zones. Similarly, the filler materials in some of the tubes maybe different than the filler materials in other tubes to thereby posturize the mattress with different firmness zones.

In an alternative embodiment, the individual tubes filled with filler material are sandwiched between layers of scrim which preferably is non-woven material but may be other materials as well. The scrim layers or sheets function to hold the stuffed or filled tubes together as well as providing an additional cushioning effect.

In an alternative embodiment, the individual tubes, at least partially filled with filler material, are connected together with fabric strips of non-woven material, woven material or other materials. The fabric strips may be adhesively or otherwise secured to the tubes.

Advantageously, a variety of different mattress designs with respect to firmness, loft, feel and other characteristics can be obtained with this invention by inserting selected materials into selected tubes to provide a posturized product.

The present invention has multiple applications other than being utilized on top of a standard spring assembly. For example the topper of the present invention may be used with non-coil spring mattresses, box springs or as a stand-alone unit by itself or as a replacement for a waterbed insert.

As such, a bedding or seating product is provided according to this invention that may be easily adapted or modified at the factory or thereafter to achieve desired firmness characteristics according to a specific bedding manufacturer's interest or firmness requirements.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
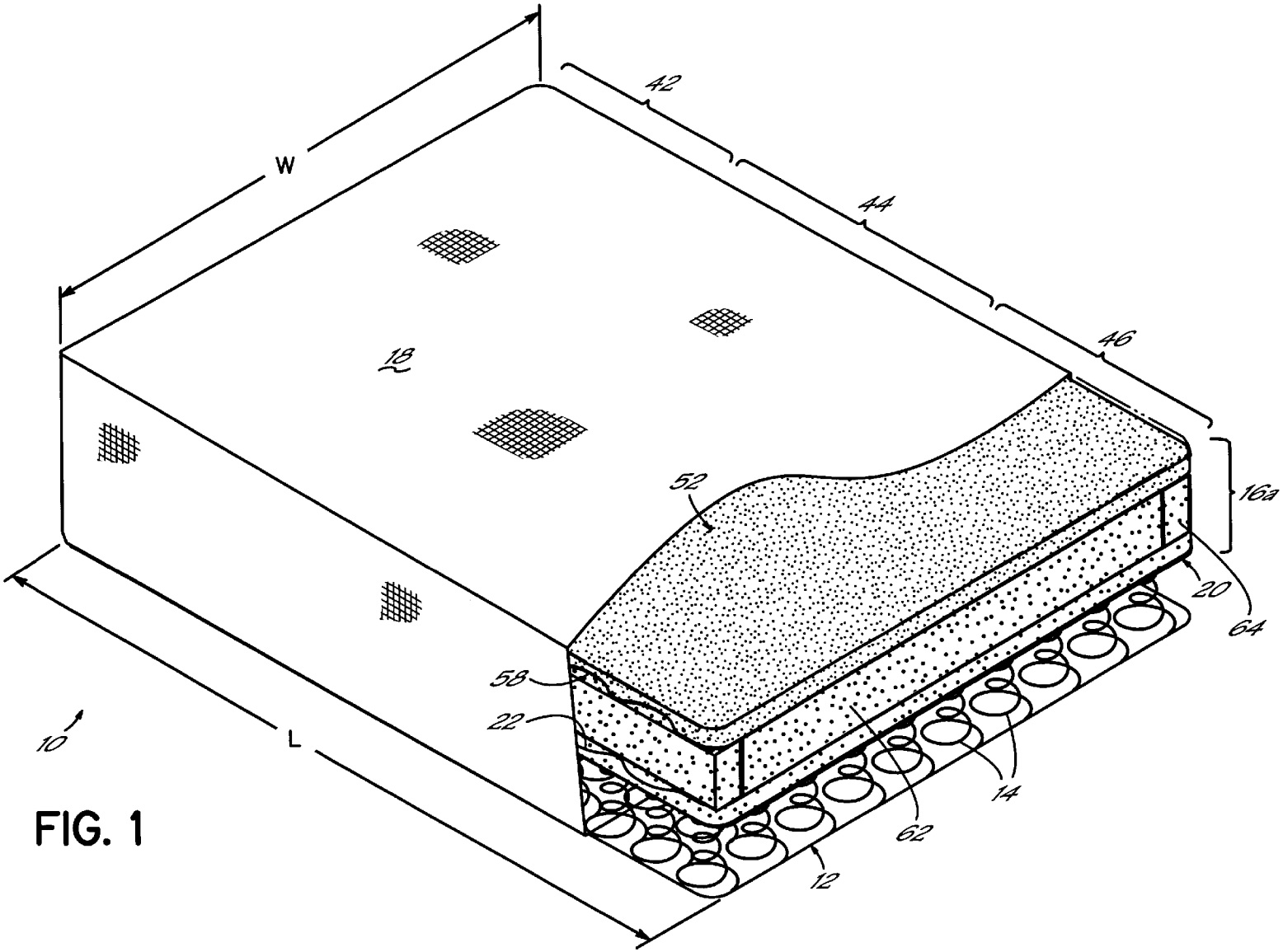
FIG. 1 is a partially broken-away perspective view of a mattress comprising a spring assembly and one preferred embodiment of the topper of the present invention encased in a fabric covering.

Referring to the drawings, and particularly to FIG. 1, there is illustrated a bedding or seating product 10 incorporating the present invention. FIG. 1 illustrates a spring assembly 12 comprising a plurality of aligned, interconnected coil springs 14 as is well known in the art. The spring assembly 12 may take any one of many known forms and may include different types of springs, border wires, edge supports, pocketed coil springs or the like known in the bedding industry.

Figure 2:
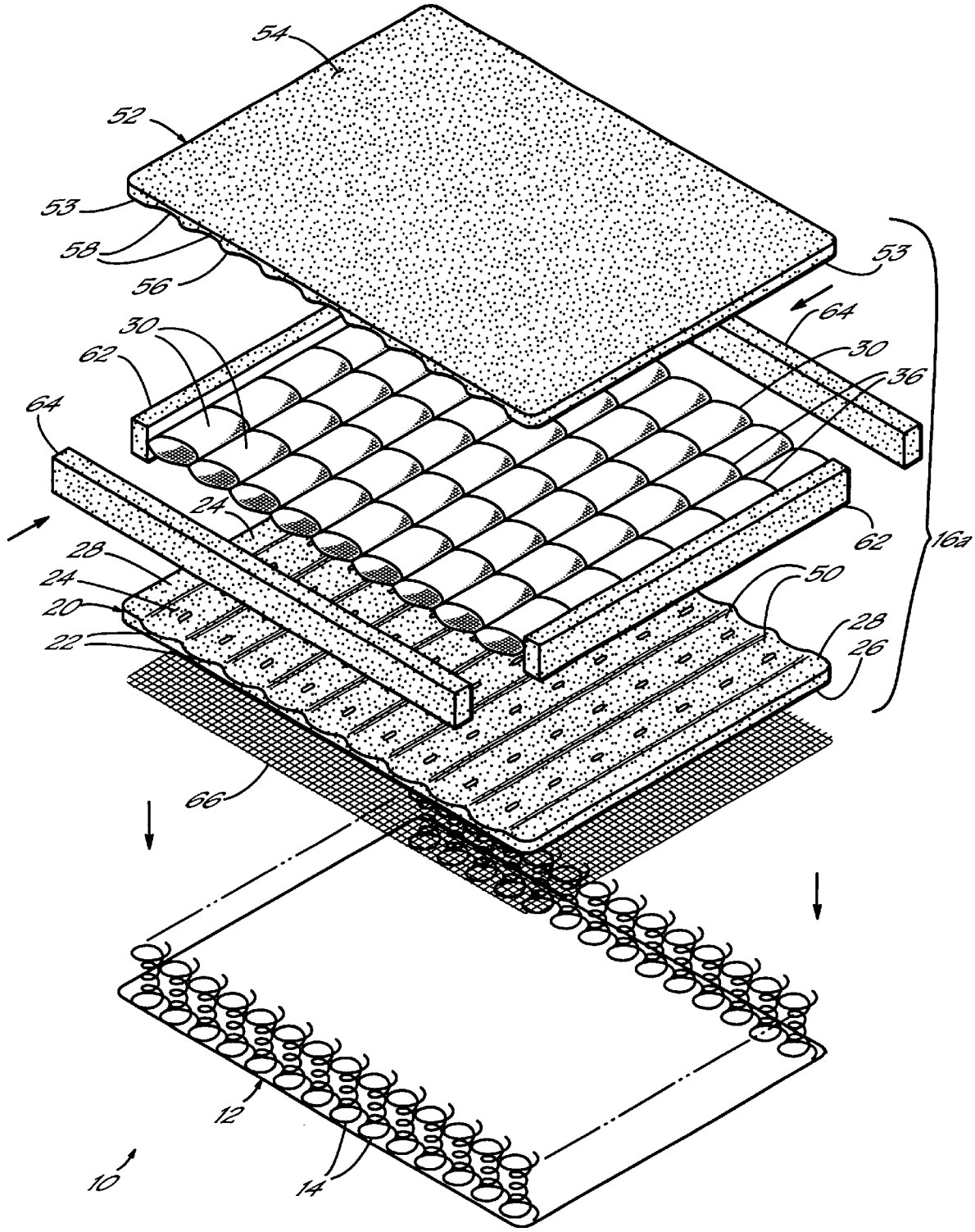
FIG. 2 is an exploded view of the mattress of FIG. 1 without the fabric covering.

Referring to FIG. 1, a topper 16*a* is positioned atop the spring assembly 12. The topper 16*a* illustrated in FIGS. 1 and 2 is one of several preferred embodiments of the present invention. A fabric covering 18 encases the topper 16*a* and the spring assembly 12.

As seen in FIG. 2, topper 16*a* comprises a first or lower foam layer 20 having a number of generally parallel arcuate-shaped cradles 22 formed in a top surface 24 thereof. The first foam layer 20 also has a generally planar lower surface 26 adapted to contact the spring assembly 12.

The cradles 22 are illustrated as extending transversely from side to side. However, the cradles 22 formed in the first foam layer 20 may extend longitudinally (from head to foot) if desired.

The first foam layer 20 is preferably one piece of foam which may be any size depending upon the application. However, multiple pieces joined together may make up the first foam layer 20.

In one presently preferred embodiment, that of a queen size mattress, the topper 16*a* measures 80 inches in length (L) and 60 inches in width (W) and has a 2 inch thickness. The transversely extending cradles 22 are each 1 inch deep, 8 inches wide and extend across the entire width of the first foam layer 20. Four inch wide generally planar end regions 28 at the head and foot of the first foam layer 20 are provided.

Figure 6:
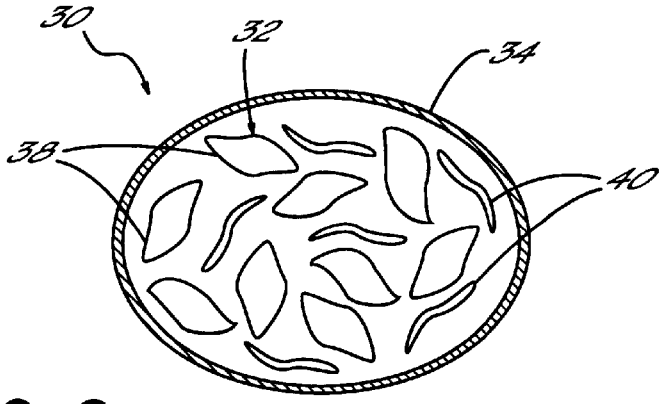
FIG. 6 is a cross-sectional view of one of the individual tubes of the topper of the present invention.

Positioned atop the first foam layer 20 are a plurality of individual tubes 30 adapted to be received inside the cradles 22 of the first foam layer 18. As illustrated in FIG. 6 each of the individual tubes 30 is at least partially stuffed with filler material 32. Each individual tube 30 comprises a quantity of filler material 32 surrounded by a fabric casing 34. The individual tubes 30 are illustrated extending from side to side, i.e. across the width W of the product as illustrated. However, the individual tubes 30 may extend longitudinally (from head to foot) provided the cradles 22 are similarly oriented.

The individual tubes 30 may be any size. In one preferred embodiment of the present invention, each tube 30 is approximately 60 inches in length and 8 inches in width and may include spaced stitch lines 36 along the length thereof as shown in FIGS. 2–5.

As illustrated in FIG. 6, the filler material 32 is preferably a combination of shredded foam pieces 38 and shredded fibers 40. However other materials such as down feathers or wool may be stuffed inside the tubes 30. In one preferred embodiment of this invention, each tube 30 includes shredded fiber holcore and shredded prime foam having a density of 1.5 lbs/ft$^3$.

The quantity and type of filler material 32 inside the tubes 30 may be altered as desired to provide the desired firmness of each individual tube 30. As such, posturization of the topper can be obtained by customizing the specific tubes 30 provided in various regions or zones of the unit 10. Alternatively, solid tubes of foam can be utilized in selected cradles as desired. Different supportive material may be provided in specific tubes 30 or groups of tubes to provide for posturization and unique lumbar or other body zone region support as is required.

As illustrated in FIG. 1, the bedding product 10 may be divided into multiple zones or regions of differing firmness due to the composition inside the tubes 30 of the different regions. FIG. 1 illustrates a head section 42, a center section 44 and a leg section 46. Although FIG. 1 illustrates three separate longitudinally extending zones or regions of the product 10, the product 10 may be separated into any number of longitudinally extending zones or regions in accordance with the present invention. Alternatively, the tubes 30 of the topper 16*a* could run longitudinally and the product 10 be separated into a plurality of transversely extending zones or regions due to the firmness characteristics of the tubes within the different zones or regions. For example, a mattress could be divided into two regions of differing firmness, a his region of increased firmness and a her region of lesser firmness.

As illustrated in FIG. 2, each tube 30 is preferably secured in one of the respective cradles 22 by deposits of adhesive 50. The deposits of adhesive 50 are spaced along the length of the cradles 22 of the first foam layer. Other means of securing the tubes 30 in the cradles 22 may be used as well, such as for example ultrasonic welding.

In the embodiment of topper 16*a* illustrated in FIGS. 1 and 2, the tubes 30 are preferably not secured to each other to provide for independent support and action from one another. However, the tubes 30 may be secured to each other if desired.

As illustrated in FIG. 2, the topper 16*a* further comprises a second or upper foam layer 52 positioned or located above the individual tubes 30. The second foam layer 52 has a generally planar upper surface 54 and a lower surface 56 in which a plurality of cradles 58 are formed. The cradles 58 are sized so as to receive upper portions of the individual tubes 30. Preferably, the cradles 58 are the same size as the cradles 22 formed in the first or lower foam layer 20. At the ends of the second foam layer 52 generally planar end regions 53 are provided in the lower surface 56 of the foam layer.

Surrounding the individual tubes 30 is a foam perimeter made of four individual foam pieces: a pair of transversely extending end pieces 62 and a pair of longitudinally extending side pieces 64. The end pieces 62 are located above the end regions 28 of the first foam layer 20 and below the end regions 53 of the second foam layer 52. All of the foam pieces 62,64 are sandwiched between the first and second foam pieces 20,52.

The first and second foam layers 20, 52 and the foam pieces 62,64 of the topper 16*a* may be any type of foam. One type of foam which has proven satisfactory is foam type 1850 having a density of 1.8 lbs/ft$^3$ and an Indentation Force Deflection (IFD) of 50.

Figure 3:
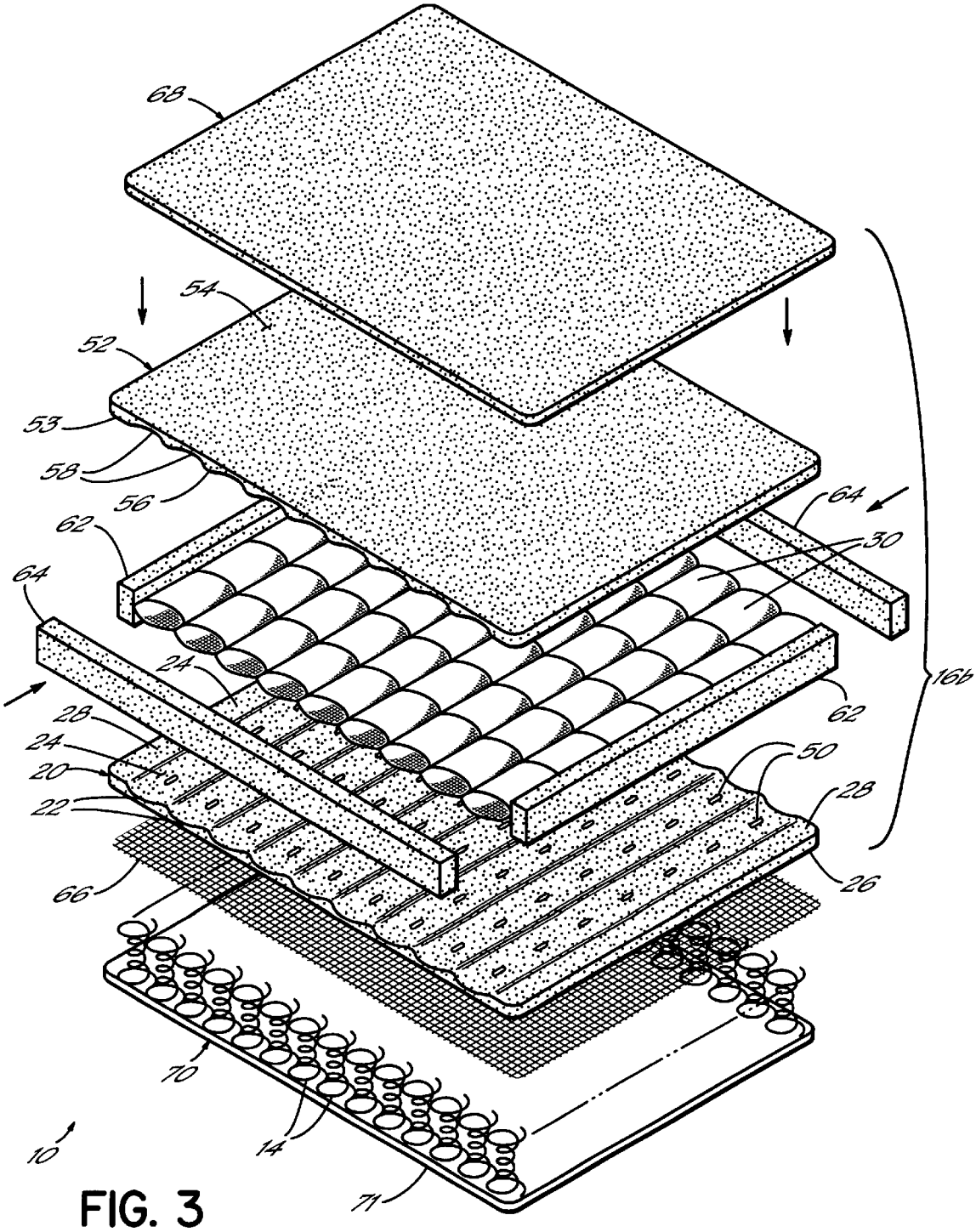
FIG. 3 is an exploded view of a mattress without a fabric covering illustrating another embodiment of the topper of the present invention.
Figure 5:
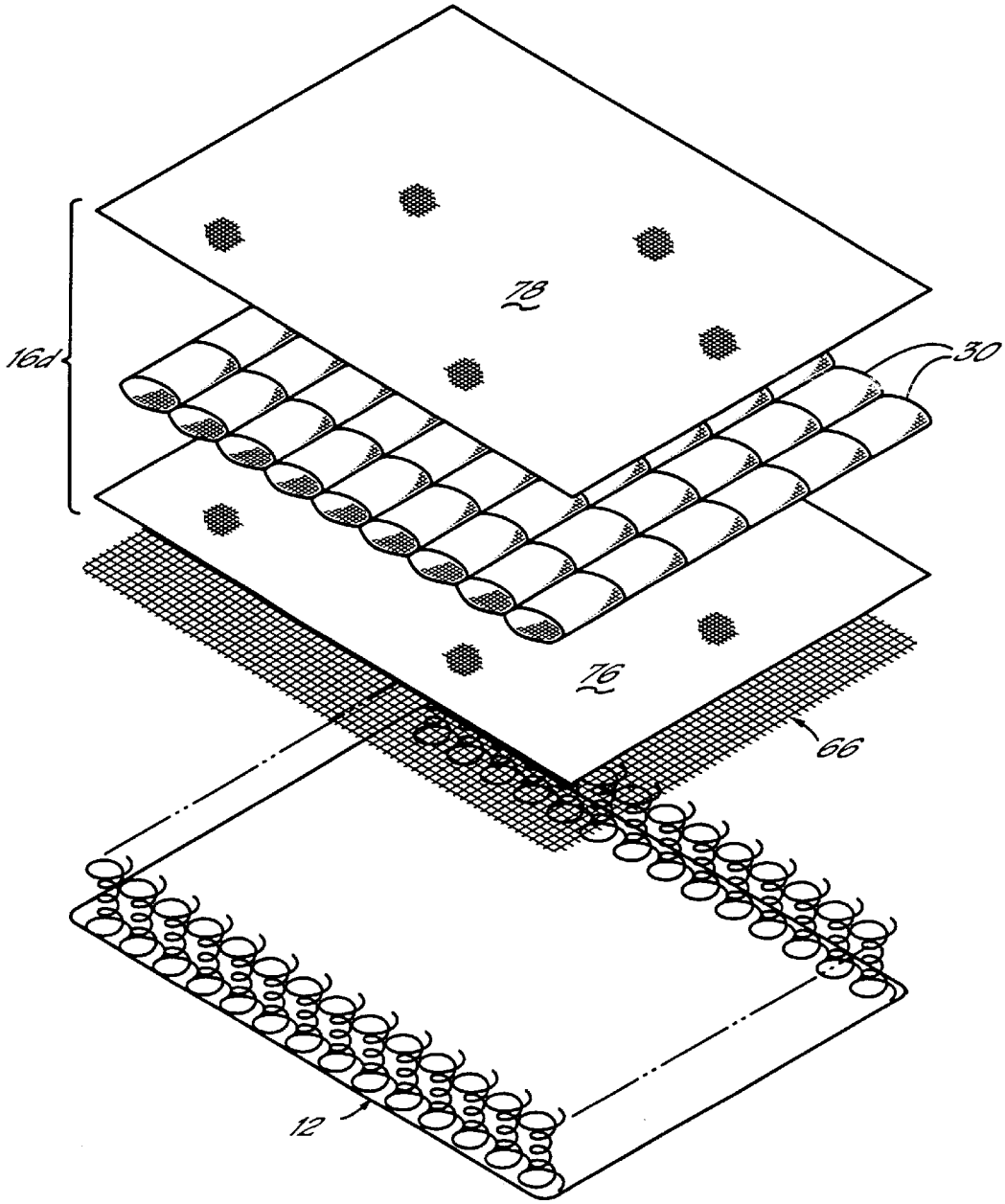
FIG. 5 is an exploded view of a mattress without a fabric covering illustrating another embodiment of the topper of the present invention.

As illustrated in FIGS. 2, 3 and 5 any of the multiple embodiments of topper of the present invention may be placed on a wire mesh member 66. However, the wire mesh member 66 may be omitted if desired, in which case the topper would rest directly on top of the spring assembly 12.

An alternative preferred embodiment of topper 16*a* is illustrated in FIG. 3. In this embodiment, the components of the topper 16*b* are identical to those described above with one addition. An additional foam layer 68 is provided on top of the second foam layer 52 to provide additional cushioning. Although the foam layer 68 is illustrated as being a unitary piece of foam, this layer may made of multiple pieces of foam or other materials.

As shown in FIG. 3, the topper 16*b* may be placed atop a mattress 70 having a base 71, as is conventional in box springs. Regardless of the base, the present invention provides a high-loft, high-comfort bedding product which can be individualized by a selection of specific tube materials and associated firmness for a posturized effect. In fact any of the topper embodiments illustrated or described in this application may be used with a box spring or equivalent structure. Additionally, any of the toppers of the present invention could be utilized by itself as a standard mattress or as a replacement for a waterbed insert.

Figure 4:
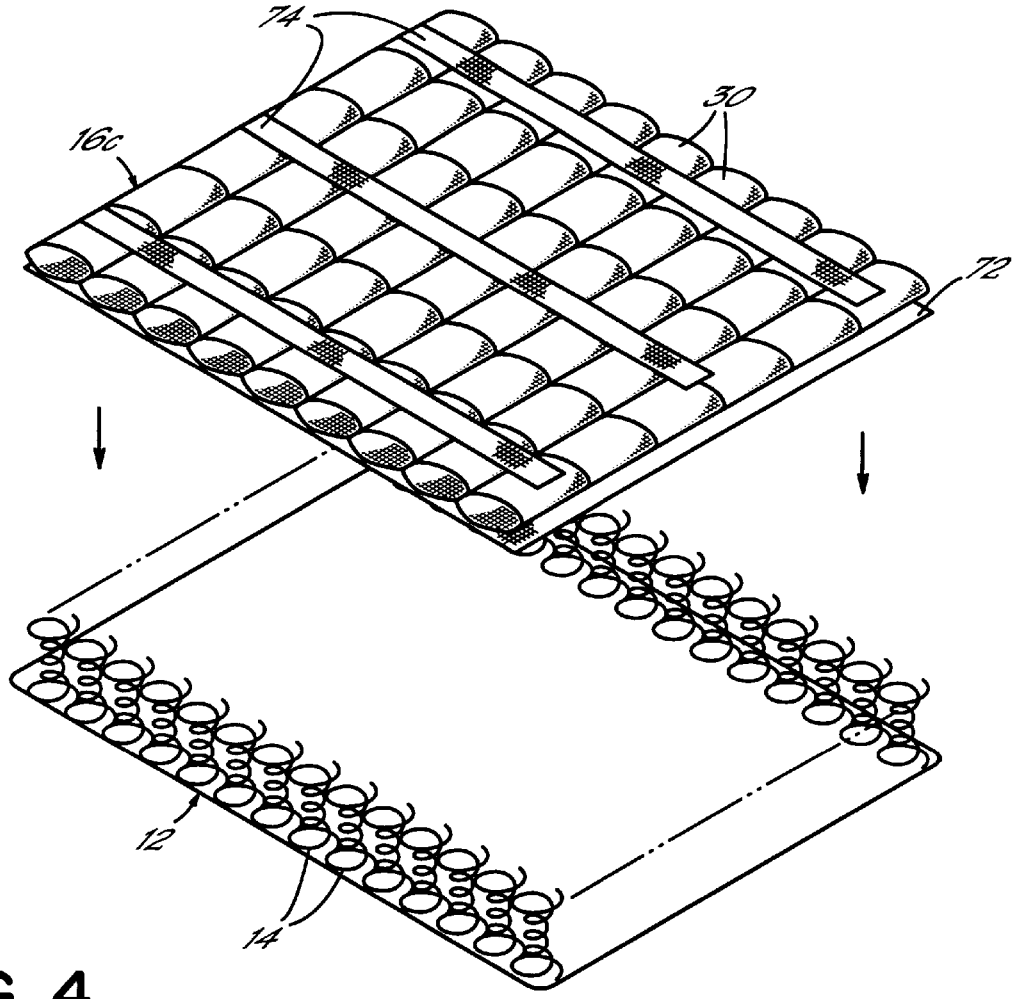
FIG. 4 is an exploded view of a mattress without a fabric covering illustrating another embodiment of the topper of the present invention.

FIG. 4 illustrates an alternative embodiment of the present invention. In this embodiment, the topper 16*c* comprises a plurality of tubes 30 which are glued, ultrasonically welded or otherwise secured to a lower scrim sheet 72. The lower scrim sheet 72 is preferably made of non-woven material but may be made of any other material.

In order to further hold the tubes 30 in place, a plurality of fabric strips 74 extend across the tops of the tubes. The fabric strips 74 are preferably glued to the upper surfaces of the tubes 30 but may be ultrasonically welded or otherwise secured thereto. The fabric strips 74 extend perpendicular to the longitudinal direction of the tubes 30. Although three fabric strips 74 are illustrated, any number of fabric strips 74 may be used. Additionally, in place of a lower scrim sheet 72, fabric strips 74 may be secured to lower surfaces of the tubes 30 in order to hold the tubes in place.

This embodiment of the present invention incorporating a topper 16*c* obviates the need for the foam layers illustrated in FIGS. 1 and 2 because the tubes are held in place with the fabric strips 74 and lower scrim sheet 72. Additionally foam blocks 62,64 illustrated in FIGS. 2 and 3 are not necessary although they may be used in this embodiment.

FIG. 5 illustrates another embodiment of the present invention. In this embodiment, topper 16*d* is located above a spring assembly 12 and wire mesh member 66 as described above. The topper 16*d* comprises a lower scrim sheet 76 and upper scrim sheet 78 sandwich a plurality of tubes 30 therebetween. Although the tubes 30 are illustrated as extending transversely, they may extend longitudinally. The scrim sheets 76, 78 and tubes 30 form a topper 16*d* which is placed on top of the wire mesh member 66 and spring assembly 12. The topper 16*d* comprises a plurality of tubes 30 which are glued, ultrasonically welded or otherwise secured to the upper and lower scrim sheets 78, 76. The scrim sheets are preferably made of non-woven material but may be made of any other materials.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A mattress comprising:

a spring assembly;

a foam layer positioned atop the spring assembly and having a plurality of generally parallel arcuate shaped cradles formed in a top surface of the foam layer; and a plurality of individual tubes each secured in one of said cradles, each of said tubes having filler materials therein.

2. The mattress of claim 1 wherein the filler materials in select tubes have a different firmness than the filler materials in other of said tubes to provide the mattress with different firmness zones.

3. The mattress of claim 1 further comprising a second foam layer positioned atop the tubes.

4. The mattress of claim 1 further comprising:

a second foam layer positioned atop the plurality of individual tubes, a bottom surface of the second foam layer having a plurality of generally parallel arcuate shaped cradles, one of the tubes being positioned in each of the second foam layer cradles.

5. The mattress of claim 1 wherein said filler materials include shredded foam.

6. The mattress of claim 1 where in said filler materials include shredded fibers.

7. A topper for use in a bedding product having a spring assembly, said topper comprising:

a foam layer positioned atop the spring assembly and having a plurality of generally parallel arcuate shaped cradles formed in a top surface of the foam layer; and a plurality of individual tubes each secured in one of said cradles, each of said tubes having filler materials therein.

8. The topper of claim 7 further comprising a second foam layer located atop the individual tubes, said second foam layer having a plurality of generally parallel arcuate shaped cradles formed in a lower surface of the foam layer.

9. The topper of claim 7 further comprising a second foam layer located atop said individual tubes.

10. The topper of claim 7 wherein the filler materials in a first portion of the topper have a different firmness than the filler materials in a second portion of the topper to provide the topper with different firmness zones.

* * * * *